US007779518B1

(12) United States Patent
Skiles

(10) Patent No.: US 7,779,518 B1
(45) Date of Patent: Aug. 24, 2010

(54) CLASP FOR ORNAMENTAL OBJECTS

(76) Inventor: William Skiles, 5901 E. Rosewood, Tucson, AZ (US) 85711

( * ) Notice: Subject to any disclaimer, the term of this patent is extended or adjusted under 35 U.S.C. 154(b) by 861 days.

(21) Appl. No.: 11/552,919

(22) Filed: Oct. 25, 2006

Related U.S. Application Data

(63) Continuation-in-part of application No. 10/994,729, filed on Nov. 22, 2004, now Pat. No. 7,127,782, which is a continuation of application No. 09/818,463, filed on Mar. 27, 2001, now Pat. No. 6,898,828.

(51) Int. Cl.
*A44C 1/00* (2006.01)
*A44C 9/00* (2006.01)
*A41F 1/00* (2006.01)

(52) U.S. Cl. ..... 24/530; 63/15.9; 63/20; 63/21

(58) Field of Classification Search ..... 24/530, 24/564, 484, 480, 545, 547, 570, 571, 550, 24/27; 63/30, 31, 29.1, 40, 4, 3.1, 3, 20, 63/21, 23, 15, 15.9; 2/209
See application file for complete search history.

(56) References Cited

U.S. PATENT DOCUMENTS

| | | | | | |
|---|---|---|---|---|---|
| 1,251,308 | A | | 12/1917 | Wecht | 24/564 |
| 2,125,768 | A | * | 8/1938 | Christensen et al. | 24/564 |
| 2,589,476 | A | * | 3/1952 | Casey | 24/564 |
| 2,669,102 | A | * | 2/1954 | Ronstadt | 63/14.8 |
| 3,014,298 | A | | 12/1961 | Kirshner | 63/29.1 |
| 3,693,376 | A | | 9/1972 | Willner | 63/29.1 X |
| 3,896,527 | A | | 7/1975 | Miller et al. | 24/499 |
| 4,139,667 | A | | 2/1979 | Blue | 428/38 |
| 4,195,492 | A | | 4/1980 | Johnson | 63/29.1 X |
| 4,457,756 | A | | 7/1984 | Kern et al. | 604/286 |
| 4,536,924 | A | | 8/1985 | Willoughby | 24/545 X |
| 4,569,105 | A | * | 2/1986 | Weider | 24/550 |
| 4,625,526 | A | | 12/1986 | Milawski | 63/29.1 X |
| 4,835,824 | A | | 6/1989 | Durham et al. | 24/339 |
| 5,022,126 | A | | 6/1991 | Davis | 24/543 |
| 5,129,730 | A | | 7/1992 | Someah et al. | 366/160.5 |
| 5,433,090 | A | | 7/1995 | Santiago | 63/29.1 |
| 5,440,791 | A | | 8/1995 | Guio | 24/545 |
| D363,545 | S | | 10/1995 | Miller | D24/143 |
| 5,683,405 | A | * | 11/1997 | Yacoubian et al. | 24/545 |
| 5,709,013 | A | * | 1/1998 | Stanback | 63/29.1 |
| 5,755,413 | A | * | 5/1998 | Press | 24/570 |
| 5,803,687 | A | | 9/1998 | Ledingham | 411/85 |
| 5,946,943 | A | | 9/1999 | Hanson | 63/29.1 X |
| D426,767 | S | | 6/2000 | Meyers | D8/395 |
| 6,101,655 | A | | 8/2000 | Buddle | 12/146 C |
| 6,127,457 | A | | 10/2000 | Darling | 523/218 |
| 6,675,611 | B2 | * | 1/2004 | Hunter | 63/3.1 |
| 6,898,828 | B2 | | 5/2005 | Skiles | 24/530 |
| 6,925,687 | B1 | | 8/2005 | Overton | 24/543 |
| 6,926,169 | B2 | * | 8/2005 | Burato et al. | 24/27 |

FOREIGN PATENT DOCUMENTS

| | | | |
|---|---|---|---|
| DE | 31 04 396 A1 | 8/1982 | 63/29.1 |

* cited by examiner

*Primary Examiner*—Robert J Sandy
(74) *Attorney, Agent, or Firm*—Hayes Soloway P.C.

(57) ABSTRACT

A clasp apparatus to releaseably hold an ornamental object. That ornamental object may have a spherical shape or an irregular shape.

14 Claims, 13 Drawing Sheets

CLASP FOR ORNAMENTAL OBJECTS

CROSS-REFERENCE TO RELATED APPLICATIONS

The present application is a continuation-in-part of application Ser. No. 10/994,729, filed Nov. 22, 2004, now U.S. Pat. No. 7,127,782 which is a continuation of application Ser. No. 09/818,463, entitled "Clasp for Ornamental Objects," filed Mar. 27, 2001, now U.S. Pat. No. 6,898,828, issued May 31, 2005, the contents of which are incorporated herein by reference.

FIELD OF THE INVENTION

The present invention relates to an improved apparatus for releaseably fixturing an ornamental object.

BACKGROUND OF THE INVENTION

An ornamental object can be converted into a piece of jewelry by adding thereto an attachment fixture which facilitates display of the ornament. Different types of jewelry have different types of attachment fixtures. Jewelry such as rings and necklaces must be equipped with fixtures which facilitate attachment of an ornament to particular parts of the human body, while lapel pins and belt buckles have fixtures designed to facilitate attachment of the ornament to particular pieces of clothing.

Using prior art devices, the unique nature of each type of attachment fixture limits the versatility of the jewelry. In addition, prior art attachment fixtures often alter, mar, and to some degree damage, the piece of jewelry to which those fixtures are affixed. Furthermore, the additional bulk also prevented proper display of the jewelry by causing it to stand away from the body or tilt to one side.

In my copending application and parent patent I describe a clasp that securely and releaseably holds an ornamental object such that the securely/releaseably fixtured ornamental object can we worn as a piece of jewelry, and subsequently easily removed from that clasp.

SUMMARY OF THE INVENTION

The present invention provides an alternative clasp for releaseably holding an ornamental object. The clasp includes a first ring shaped fixture and a second ring shaped fixture joined to the first ring shaped fixture by a bridging member so that the ring shaped fixtures face one another at an angle. In a preferred embodiment, the first and second ring shaped fixtures and the bridging member are formed as a unitary construction. Alternatively, the first and second ring shaped fixtures and the bridging member may be separate pieces joined to one another. The bridging member is resiliently deformable so that an ornamental object such as a marble may be loaded into and compressively held between the first and second ring shaped fixtures.

BRIEF DESCRIPTION OF THE DRAWINGS

The invention will be better understood from a reading of the following detailed description taken in conjunction with the drawings in which like reference designators are used to designate like elements, and in which.

DETAILED DESCRIPTION OF THE PREFERRED EMBODIMENTS

Figure 1:
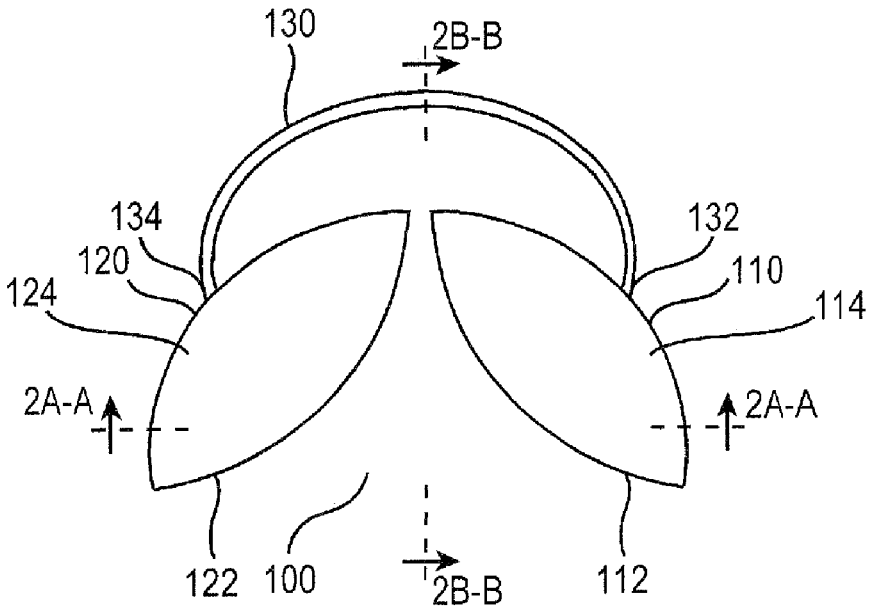
FIG. 1 is a side view of one embodiment of a clasp in accordance with my parent patent application.

Referring to FIG. 1, clasp 100 includes first fixture 110, second fixture 120, and member 130. First fixture 110 includes outer surface 114. Second fixture 120 includes outer surface 124. Member 130 includes first end 132 and second end 134. First end 132 is disposed on outer surface 114. Second end 134 is disposed on outer surface 124. In the embodiment shown in FIG. 1, member 130 has a semicircular shape. In other embodiments, member 130 has a U-shape or an irregular shape.

Figure 2A:
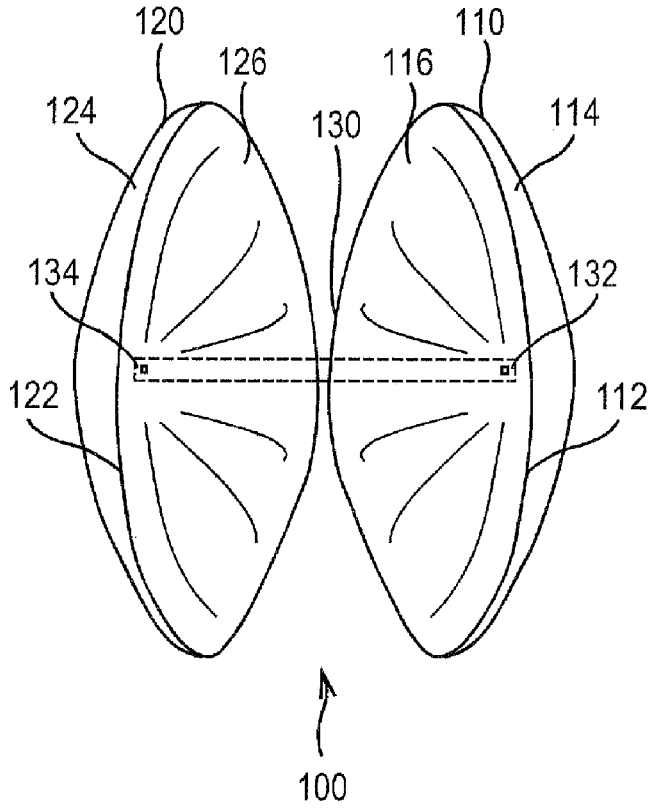
FIG. 2A is a view along the A-A' axis of the first embodiment of FIG. 1.

Referring to FIG. 2A, first fixture 110 further includes inner surface 116. Outer surface 114 and inner surface 116 are continuously joined by first edge 112. In the embodiment shown in FIGS. 1 and 2, first fixture 110 has a convexoconcave shape wherein inner surface 116 has a concave shape and outer surface 114 has a convex shape. In alternative embodiments, first fixture 110 has a planoconcave shape wherein inner surface 116 has a concave shape and outer surface 114 has a flat shape.

Second fixture 120 further includes inner surface 126. Outer surface 124 and inner surface 126 are continuously joined by second edge 122. In the embodiment shown in FIGS. 1 and 2, second fixture 120 has a convexoconcave shape wherein inner surface 126 has a concave shape and outer surface 124 has a convex shape. In alternative embodiments, second fixture 120 has a planoconcave shape wherein inner surface 126 has a concave shape and outer surface 124 has a flat shape.

In one embodiment, first fixture 110 and second fixture 120 have the same dimensions and shape. In another embodiment, first fixture 110 and second fixture 120 have differing dimensions and/or differing shapes.

Figure 2B:
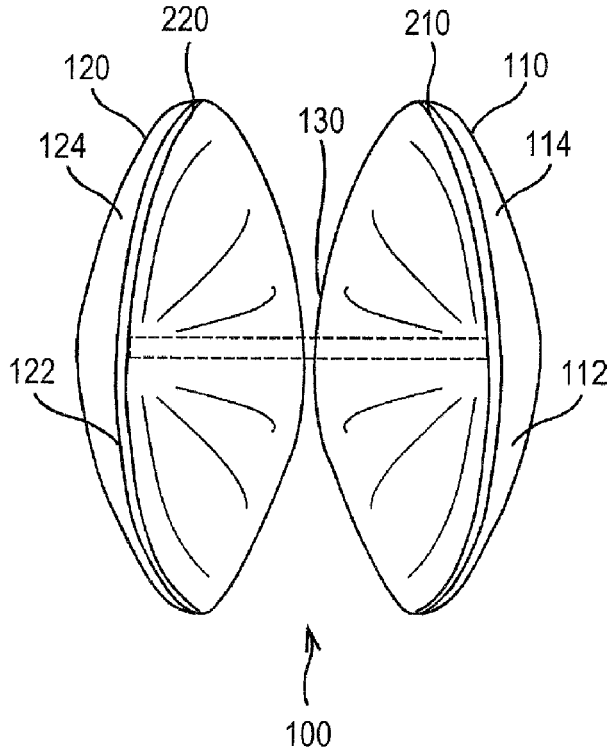
FIG. 2B is a side view along the A-A' axis of a second embodiment of clasp apparatus according to my parent patent application.

In yet another embodiment shown in FIG. 2B, flexible cellular material 210 is disposed on inner surface 116 of first fixture 110. Flexible cellular material 210 comprises a polyethylene foam, a polyurethane foam, and the like. The thickness of cellular material 210 is between about 0.10 inches and about 0.25 inch. Flexible cellular material 210 has a density of at least about 1.8 pounds per cubic foot. Flexible cellular material 210 has an ILD at 25% compression of between about 18 pounds of pressure and about 59 pounds of pressure. As used herein "ILD" stands for Indentation Load Deflection, and refers to the firmness of a piece of foam. In order to determine a flexible cellular material's ILD, a testing laboratory places a 4"×15"×15" piece of that foam on a flat surface. Then a round metal plate, 12" in diameter, pushes down on that piece of foam. The amount of pounds of pressure it takes to squeeze that 4" piece of foam to 3 inches (25% compression) is referred to as the ILD.

Flexible cellular material 220 is disposed on inner surface 126 of fixture 120. Flexible cellular material 220 comprises a polyethylene foam, a polyurethane foam, and the like. The thickness of cellular material 220 is between about 0.10 inches and about 0.25 inch. Flexible cellular material 220 has a density of at least about 1.8 pounds per cubic foot. Flexible cellular material 220 has an ILD at 25% compression of between about 18 pounds of pressure and about 59 pounds of pressure.

Flexible cellular material 210 and flexible cellular material 220 may have the same or differing compositions, densities, thicknesses, and/or ILDs. These foams serve multiple purposes. First, flexible cellular material 210 and flexible cellular material 220 protect the surface of the ornamental object fixtured.

Second, these foams allow secure fixturing of ornamental objects that are not spherical or substantially spherical, but rather have irregular shapes. When such an irregularly shaped object is inserted between first fixture 110 and second fixture 120, first flexible cellular material 210 and second flexible cellular material 220 each conform to the shape of those portions of the irregularly-shaped object to which those materials are in contact, thereby securely, but releaseably, holding that irregularly shaped object in the clasp device.

Figure 3:
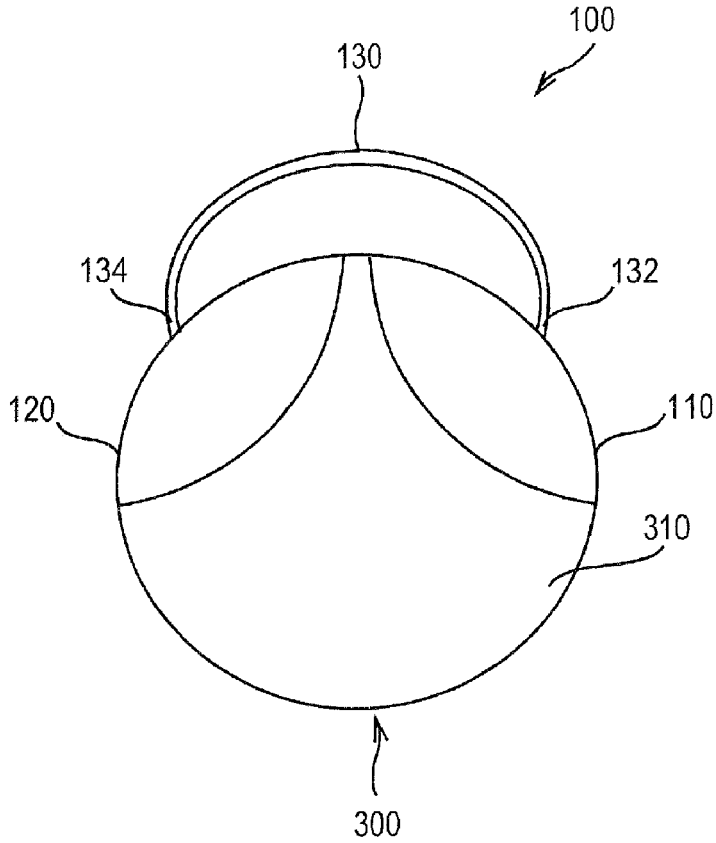
FIG. 3 is a side view of a clasp apparatus of FIG. 1 releaseably holding an ornamental object.

Turning to FIG. 3, apparatus 300 comprises a piece of jewelry which includes clasp 100 releaseably fixturing ornamental object 310. Ornamental object 310 comprises both natural and human-made objects, including but not limited to ornamental stones, clear and/or tinted marbles, and precious gems such as diamonds, rubies, and the like. In the embodiment shown in FIG. 3, ornamental object 310 has a spherical shape. In other embodiments, ornamental object 310 has an irregular shape.

Figure 4A:
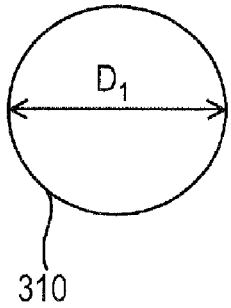
FIG. 4A is a side view of the ornamental object shown in FIG. 3.
Figure 4B:
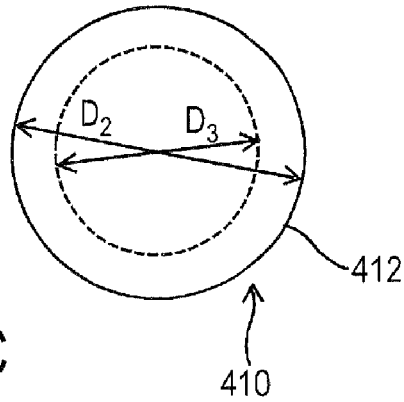
FIG. 4B shows a side view of a spherical-shaped shell.

FIGS. 4*a* through 4D illustrate the relationship between the dimensions of fixture 110, fixture 120, and ornamental object 310. Referring to FIG. 4A, ornamental object 310 has a diameter D1. Referring to FIG. 4B, spherical-shaped shell 410 has outer surface 412 having a diameter D2 and an inner surface having a diameter D3. Diameter D3 is substantially equal to diameter D1. By substantially equal, Applicant means diameter D3 equals diameter D1 plus or minus ten percent (+/−10%).

Figure 4C:
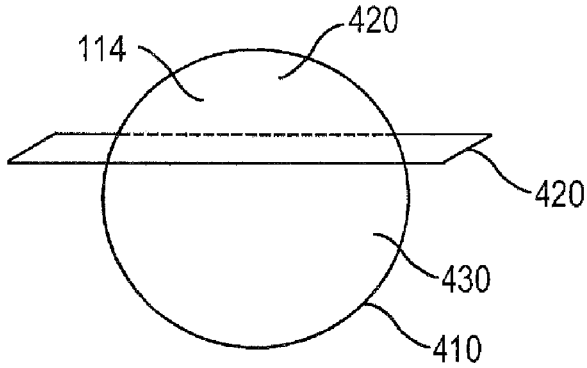
FIG. 4C shows a plane truncating the spherical-shaped shell of FIG. 3.
Figure 4D:
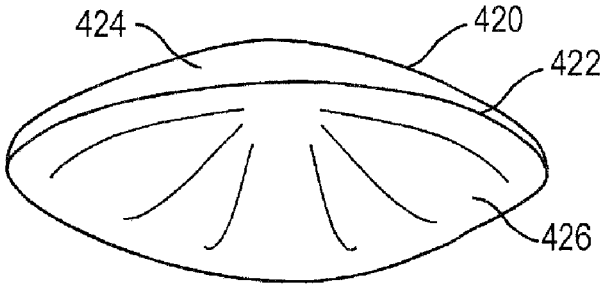
FIG. 4D shows a truncated portion of that spherical-shaped shell.
Figure 5:
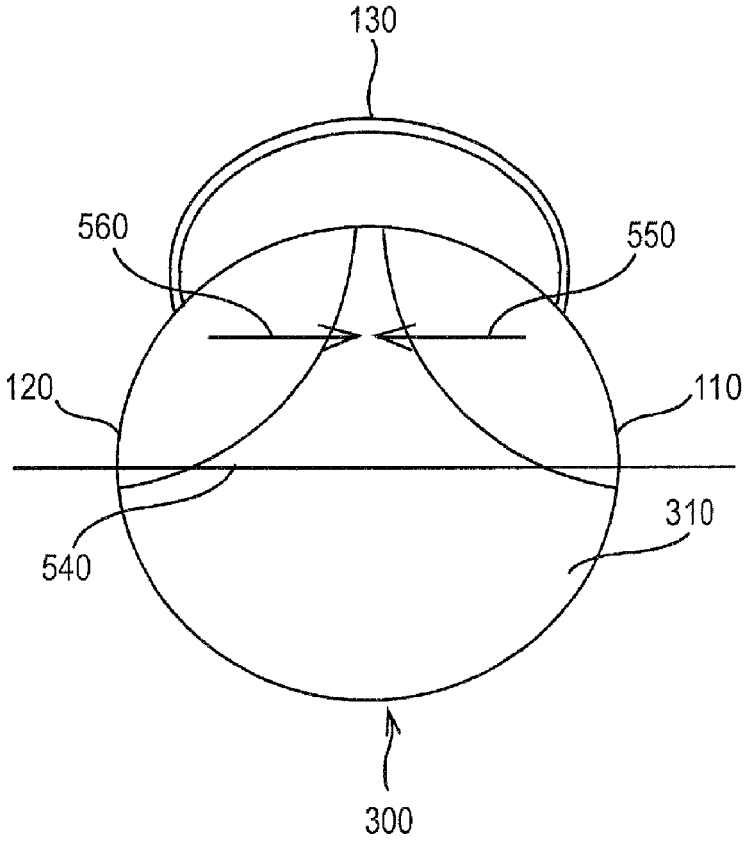
FIG. 5 is a view similar to FIG. 1. showing the forces applied by the apparatus to releaseably hold an ornamental object.

Fixture 110 and Fixture 120 (FIGS. 1, 2, 3) comprise truncated portions of spherical-shaped shell 410. Referring to FIG. 4C, plane 420 bisects shell 410 to form first truncated spherical shell 420 and second truncated spherical shell 430. First truncated spherical shell 420 includes outer surface 424, inner surface 426, and edge 422 which continuously joins inner outer surface 424 and inner surface 426. Fixture 110 (FIG. 3) and/or fixture 120 (FIG. 3) can comprise first truncated spherical shell 420. Referring now to FIG. 5, ornamental object 310 having diameter D1 (FIG. 4A) is releaseably fixtured in apparatus 300. Apparatus 300 includes first fixture 110, second fixture 120, and member 130. First fixture 110 and second fixture 120 comprise truncated portions of spherical shells having outer diameters D2 (FIG. 4B) and inner diameters D3 (FIG. 4B), such that inner diameters D3 are substantially equal to diameter D1. Inner surface 116 (FIG. 2) of first fixture 110 contacts object 310. Inner surface 126 (FIG. 2) of second fixture 120 contacts object 310.

Diameter 540 comprises that diameter of object 310 which symmetrically intersects both first fixture 110 and second fixture 120. The sizes and orientations of first fixture 110 and second fixture 120 are adjusted such that no portion of first fixture 110 overlaps any portion of second fixture 120, and such that at least one diameter of object 310, such as diameter 540, intersects some portion of both first fixture 110 and some portion of second fixture 120.

Referring again to FIG. 5, first fixture 110 exerts first force 550 against object 310 urging object 310 into tight contact with second fixture 120. Similarly, second fixture 120 exerts second force 560 against object 310 urging object 310 into tight contact with first fixture 110. First force 550 in combination with second force 560 securely but releaseably holds ornamental object 310 in clasp apparatus 300. The magnitude of first force 550 can be adjusted by varying, for example, the area of inner surface 116 in contact with object 310. Similarly, the magnitude of second force 560 can be adjusted by, for example, varying the area of inner surface 126 in contact with object 310. As those areas of contact are increased, forces 550 and 560, respectively, are increased. First force 550 and second force 560 can also be adjusted by varying the thickness and composition of member 13. For example, as the flexural modulus of member 130 increases, the magnitudes of first force 550 and second force 560 also increase.

Figure 6:
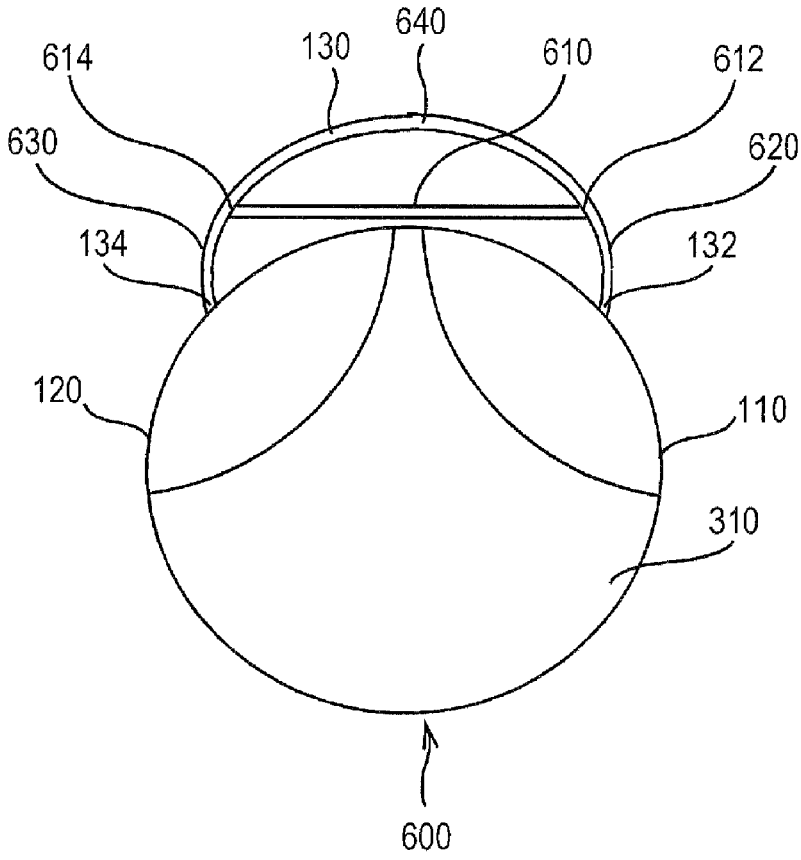
FIG. 6 is a side view of a third embodiment of clasp apparatus according to my parent patent application.

Referring to FIG. 6, apparatus 600 includes member 130 disposed between first fixture 110 and second fixture 120. Member 130 includes first end 132 connected to first fixture 110 and second end 134 connected to second fixture 120. Member 130 further includes first end component 620, second end component 630, and midpoint 640. First end component 620 connects first end 132 and midpoint 640. Second end component 630 connects second end 134 and midpoint 640. Closure apparatus 610 includes first end 612 and second end 614. First end 614 connects to first end component 620. Second end 614 connects to second end component 630. Closure apparatus 610 acts to shorten the distance between first end 134 of member 130 and second end 132 of member 130, thereby increasing the resultant compressive force fixturing ornamental object 310.

Figure 7:
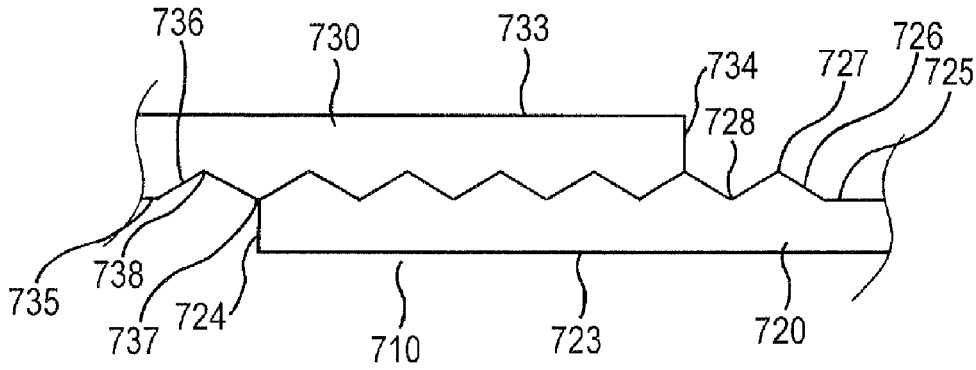
FIG. 7 is a side view of one embodiment of a closure device used in the third embodiment according to my parent patent application.

FIG. 7 shows an embodiment wherein closure apparatus 710 includes first connector 720 and second connector 730. First connector 720 includes proximal end 722 (not shown in FIG. 7) disposed on first end portion 620 (FIG. 6) and distal end 724 extending outwardly from first end portion 620 in the direction of second end portion 630 (FIG. 6). Second connector 730 includes proximal end 732 (not shown in FIG. 7) connected to second end portion 630 (FIG. 6) and distal end 734 extending outwardly from second end portion 630 in the direction of first end portion 620.

First connector 720 includes first surface 724 and opposing surface 725. Surface 725 includes a ratchet portion 726 comprising alternating elevated segments 727 and lowered segments 728. Second connector 730 includes first surface 734 and opposing surface 735. Surface 735 includes a ratchet portion 736 comprising alternating elevated segments 737 and lowered segments 738. Distal end 724 is disposed adjacent distal end 734 such that ratchet portion 726 slidingly mates with ratchet portion 736.

Urging first end portion 620 (FIG. 6) and second end portion 630 (FIG. 6) inwardly toward each other causes connector 720 to slide over connector 730 thereby reducing the distance between first end portion 620 and second end portion 630. Ratchet portions 726 and 736 slidingly mate to maintain that shortened distance when the inwardly directed forces on first end portion 620 and second end portion 630 are discontinued. As those skilled in the art will appreciate, decreasing the distance between first end portion 620 and second end portion 630 increases first force 550 (FIG. 5) and second force 560 (FIG. 5).

Figure 8:
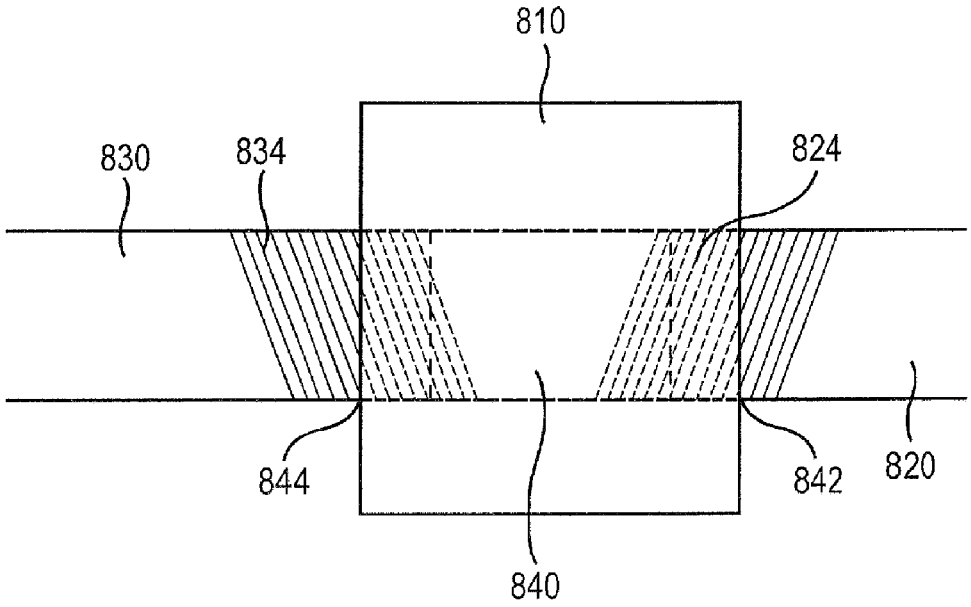
FIG. 8 is a side view of another embodiment of a closure device used in the third embodiment of my parent patent application.

Referring to FIG. 8, closure apparatus 610 (FIG. 6) comprises first connector 820, second connector 830, and body 810. First connector 820 includes proximal end 822 (not shown in FIG. 8) disposed on first end portion 620 (FIG. 6) and first threaded distal end 824 extending outwardly from first end portion 620 in the direction of second end portion 630 (FIG. 6). Second connector 830 includes proximal end 832 (not shown in FIG. 7) connected to second end portion 630 (FIG. 6) and second threaded distal end 834 extending outwardly from second end portion 630 in the direction of first end portion 620.

First threaded distal end 824 is threaded in a first orientation and second threaded distal end 834 is threaded in a second orientation. Body 810 includes aperture 840 disposed therethrough. Aperture 840 includes first opening 842 and second opening 844. First opening 842 is threaded in the first orientation. Second opening 844 is threaded the second orientation.

Body 810 is rotatably disposed on both connector 820 and connector 830. First threaded distal end 824 is rotatably disposed within first opening 842. Second threaded distal end 834 is rotatably disposed within second opening 844. Rotation of body 810 in a first direction causes first connector 820 and second connector 830 to be drawn inwardly thereby decreasing the distance between first end portion 620 (FIG. 6) and second end portion 630 (FIG. 6).

Figure 9:
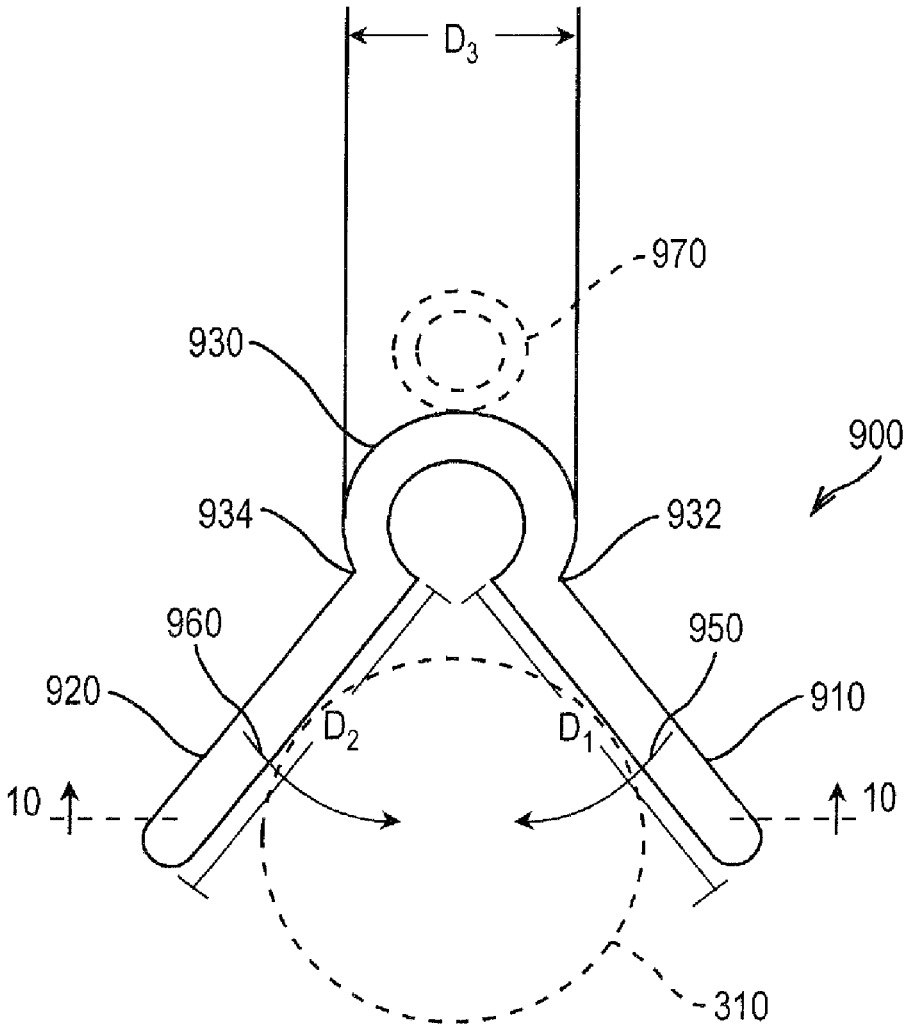
FIG. 9 is a side view of a clasp in accordance with the present invention.
Figure 10:
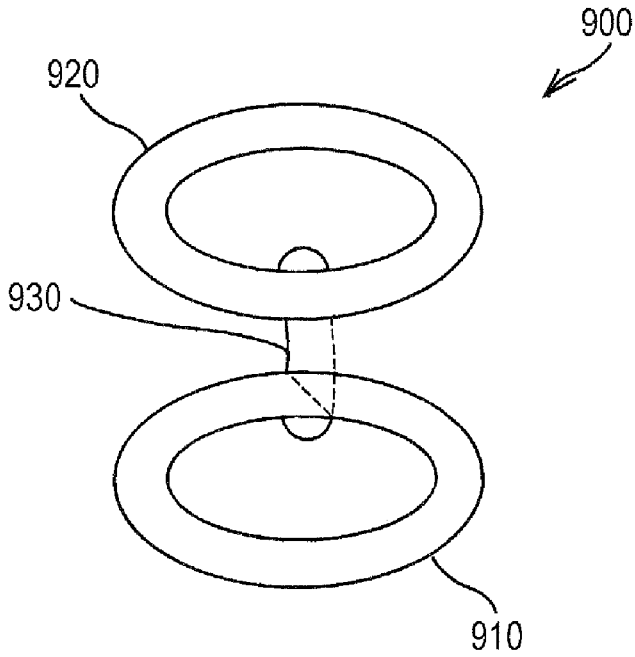
FIG. 10 is a bottom end view of the FIG. 9 clasp.

FIGS. 9 and 10 illustrate an alternative clasp 900 in accordance with the present invention, which includes a first ring-shaped fixture 910, a second ring-shaped fixture 920 joined together by a bridging section 930. Ring-shaped fixtures 910 and 920 and bridging fixture 930 may be formed of a unitary construction. Alternatively, ring-shaped fixtures 910 and 920 and bridging section 930 may be formed separately and joined together at locations 932, 934. Fixtures 910 and 920 have an inter-diameter (ID) for accommodating an ornamental object such as a marble 310. Fixtures 910 and 920 are held at an angle relative to one another so that an ornamental object 310 may be installed by pressing the object into the clasp. Similarly, the ornamental object may be removed by pulling or prying the object from the clasp. The bridging section 930 should be sufficiently resiliently deformable or flexible to permit either mounting and removal of an object.

Ring fixtures 910 and 920 are held at an angle to one another which typically may be from about 60-120°. Preferably ring fixtures 910 and 920 are held at about a 90° angle to one another.

Figure 11:
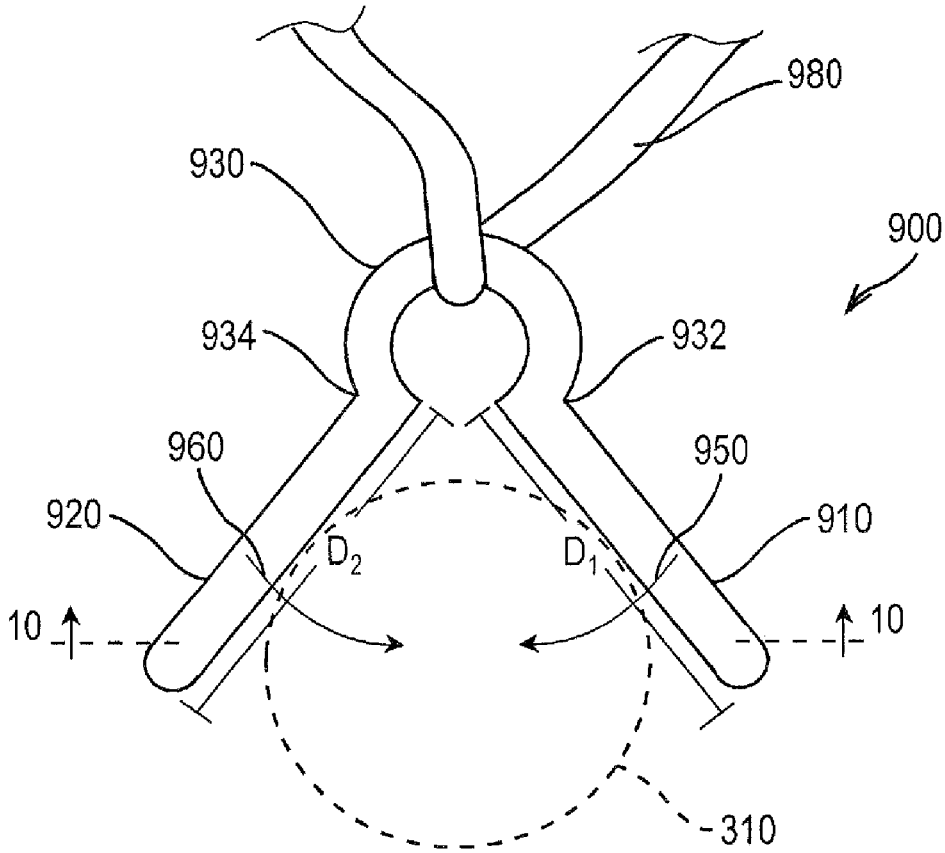
FIGS. 11 and 12 are views, similar to FIG. 9, showing two additional alternative embodiments of my invention.
Figure 12:
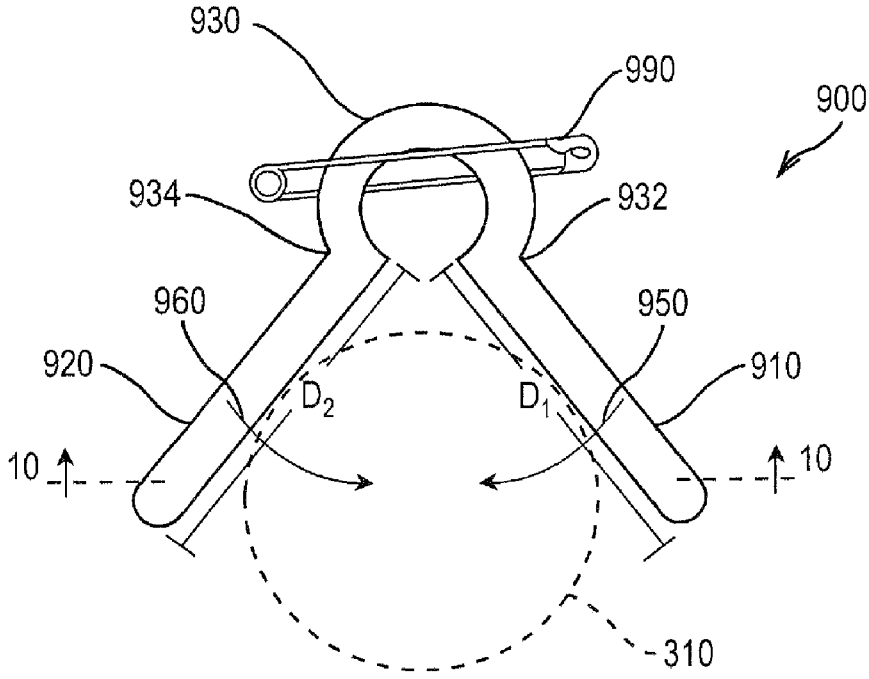

Bridging section 930 may have a shape and size to permit the clasp 900 to be worn as a finger or toe ring. Alternatively, as shown in FIG. 11, the clasp may be worn as a necklace or chain by threading a necklace or chain 980 through the clasp between the bridging section 930 and the ornamental object 310. Alternatively, as shown in phantom at 970, a ring may be provided for receiving a string from a necklace or chain. Referring to FIG. 12, the clasp also may be provided with a safety pin 990 so that the clasp may be worn as a pendant or an earring.

As in the case of the previous embodiments, in use, the ring fixtures 910 and 920 exert forces 950, 960 against an object 310 held therebetween. Forces 950 and 960 securely but releaseably hold an ornamental object 310 in the clasp 900. The magnitude of forces 950 and 960 can be adjusted by varying, for example, the diameters or circular cross-sections of first and second ring fixtures 910 and 920, thereby varying the surface area in contact with object 310 and/or the size and resiliency of bridging section 930. As the size of the circular cross-sections are increased or the diameters D1 or D2 are varied towards optimum, i.e., a diameter slightly smaller than the diameter of the object 310, forces 950 and 960 increase. First force 950 and second force 960 also can be adjusted by varying the thickness and composition of bridging section 930. For example, as the flexural modulus of bridging section 930 increases, the magnitudes of first force 950 and second force 960 also will increase.

The clasp, i.e. first ring fixture 910, second ring fixture 920, and bridging section 930 may be formed of an unitary construction, or three pieces formed together. Preferably the clasp comprises an unitary construction and is formed of a resiliently deformable material such as plastic or metal. Also, if desired, the surfaces of fixtures 910 and 920 intended for contact with object 310 may be coated with a foam or other resiliently deformable material.

Various changes may be made in the foregoing without departing from the spirit and scope of the invention. For example, while the "ring" fixtures 910 and 920 have been known as being angular in shape, ring fixtures 910, 920 may have a variety of shapes including oval and polygonal to accommodate various shaped objects. Other modifications are possible without departing from the scope of the first invention as set forth in the following claims.

I claim:

1. A clasp for releasably holding an ornamental object, comprising:

a first ring fixture;

a second ring fixture;

a bridging section forming the first and the second ring fixtures at an angle to one another;

a pin affixed to the bridging section; and the first ring fixture, the second ring fixture and the bridging section are of unitary construction.

2. The clasp of claim 1, wherein said first and second ring fixtures are annular in shape.

3. The clasp of claim 1, wherein the first and second ring fixtures are joined at an angle of about 60-120° relative to one another.

4. By the clasp of claim 3, wherein the first and second ring fixtures are joined at an angle of about 90° to one another.

5. The clasp of claim 1, wherein the bridging section is generally rounded shape and is sized to fit on a human's finger or toe.

6. The clasp of claim 1, wherein at least the bridging section is formed to be resiliently deformable material.

7. The clasp of claim 6, wherein the resiliently deformable material comprises a plastic or metal.

8. A decorative device comprising a clasp for releasably holding an ornamental object, comprising:

a first ring fixture; a second ring fixture;

a bridging section forming the first and the second ring fixtures at an angle to one another; and a necklace or chain releasably held by said clasp; and the first ring fixture, the second ring fixture and the bridging section are of unitary construction.

9. The decorative device of claim 8, wherein said first and second ring fixtures are annular in shape.

10. The decorative device of claim 8, wherein the first and second ring fixtures are joined at an angle of about 60-120° relative to one another.

11. The decorative device of claim 10, wherein the first and second ring fixtures are joined at an angle of about 90° to one another.

12. The decorative device of claim 8, wherein the bridging section is generally rounded shape and is sized to fit on a human's finger or toe.

13. The decorative device of claim 8, wherein at least the bridging section is formed to be resiliently deformable material.

14. The decorative device of claim 13, wherein the resiliently deformable material comprises a plastic or metal.

* * * * *